US005405193A

United States Patent [19]

Herrenbruck

[11] Patent Number: 5,405,193

[45] Date of Patent: Apr. 11, 1995

[54] COMPUTER VIDEO GAME PAK DISPLAY CABINET

[75] Inventor: Jeffery J. Herrenbruck, Port Washington, Wis.

[73] Assignee: Frank Mayer & Associates, Inc., Grafton, Wis.

[21] Appl. No.: 2,406

[22] Filed: Jan. 8, 1993

[51] Int. Cl.[6] ..... A47F 3/14; A47F 3/10

[52] U.S. Cl. ..... 312/118; 312/120; 312/123; 312/125

[58] Field of Search ..... 312/117-118, 312/120, 123, 125, 136, 216, 249.2, 249.7, 287; 211/168-169, 7; 40/104.17, 104.2, 102, 72, 1

[56] References Cited

U.S. PATENT DOCUMENTS

| | | | |
|---|---|---|---|
| 887,882 | 5/1908 | Waugh | 211/169 |
| 1,075,652 | 10/1913 | Kleber | 312/216 X |
| 3,206,958 | 8/1965 | Hudgeons et al. | 211/4 |
| 3,475,070 | 10/1969 | Hoshall | 312/117 |
| 3,556,620 | 1/1971 | Gutierrez | 312/136 |
| 3,575,478 | 4/1971 | Szobski | 312/117 |
| 3,760,952 | 9/1973 | White | 211/168 |
| 4,179,168 | 12/1979 | Isaac et al. | 312/125 |
| 4,573,749 | 3/1986 | Massaro | 312/12 |
| 4,900,107 | 2/1990 | Long et al. | 211/41 X |

*Primary Examiner*—Stephen C. Pellegrino
*Assistant Examiner*—Nancy Mulcare
*Attorney, Agent, or Firm*—Nilles & Nilles

[57] ABSTRACT

A display cabinet is provided for displaying two sides of a computer video game pak or similar merchandise in a secure enclosure. The display cabinet includes an elongated vertical enclosure unit or paddle with a set of spaced apart shelves between transparent facings or panels to form a set of vertically arranged compartments. The game paks or other merchandise are held within the compartments. The enclosure unit or paddle is pivotable back and forth in order to expose the transparent front and back facings of the paddle, thereby enabling the purchaser to view front and back sides of the merchandise, respectively. A lockable access door on the paddle is slidable between open and closed positions, and lockable in the closed position to provide security for the merchandise. Several enclosure units or paddles are pivotably mounted upon a frame by either a hinge or by pivot pins for either flipping or spinning the paddles for viewing. The frame may alternatively be either a self-standing frame, wall mounted frame, or carousel-type frame, and may further include a storage locker for stocking extra merchandise.

31 Claims, 10 Drawing Sheets

COMPUTER VIDEO GAME PAK DISPLAY CABINET

BACKGROUND OF THE INVENTION

1. Field of the Invention

This invention relates to a secure cabinet for displaying game paks used in connection with computerized video games.

2. Background of the Art

Computer video games utilize a variety of animated graphics and sounds to create a unique interactive game. The hardware for a computer video game usually includes a control processing unit, a video screen (often color), and a set of buttons, joysticks, or other input devices specially designed for use with a video game. The software for the game is provided in a separate modular disc or cartridge, known as a game pak. The player may change the game being played by simply inserting a different game pak into the control processing unit.

Game paks are typically packaged for sale in relatively thin rectangular or square boxes printed with information relating to the particular game being sold. A graphic representation of the game is normally printed on the front side of the game pak box, while a written description of the game is printed on the back on the box. Although a game pak is usually quite expensive (currently about $50–$85 for each game title), computer video games are very popular, especially with kids in their preteens and teens.

At least one major manufacturer of computer games produces a relatively large selection of game titles to choose from. That particular manufacturer currently has an inventory/supply policy whereby only two or three game paks of each title are provided to an individual retail store at any one time. If a retail store sells its entire stock of a particular game title, then the manufacturer is able to resupply that retail store with additional game paks within about one to two days.

Because of the popularity of computer video games, because of their expense, and because of the tight inventory control over such games, it is desirable to provide a cabinet for displaying the game paks in a highly visible yet secure environment. The prior art, however, does not provide such a display cabinet.

Computer video game paks are, at the present time, often stocked in an area of a retail store which is inaccessible to the purchaser in order to prevent theft. For example, video game paks may be stored in a locked cabinet behind the cashier's counter at a store. In such cabinets, game paks are usually stacked on a shelf, one lying on top of the other, with only one edge of the game pak showing the name of the game being visible through a glass panel. Since the game paks are stacked on top of each other (front to back, front to back, etc.), neither the graphics nor the written description of the game which appear on the front and back sides of the game pak box, respectively, are usually visible.

A number of theft proof displays for other kinds of merchandise are disclosed in the prior art. For example, see several earlier patents assigned to the same company as the present application, including: U.S. Pat. No. 3,517,827, issued Jun. 30, 1970, entitled Theftproof Merchandise Display; U.S. Pat. No. 3,570,676, issued Mar. 16, 1971, entitled Theftproof Merchandise Display; U.S. Pat. No. 3,661,273, issued May 9, 1972, entitled Theftproof Merchandise Display Having Holding Adaptor; U.S. Pat. No. 3,672,480, issued Jun. 27, 1972, entitled Tape Cartridge Dispenser; U.S. Pat. No. 3,722,699, issued Mar. 27, 1973; entitled Theft Proof Merchandise Display Having a Hanging-Type Holder; U.S. Pat. No. 3,820,862, issued Jun. 28, 1974, entitled Theft Proof Display Device; and, U.S. Pat. No. 4,682,825, issued Jul. 28, 1987, entitled Security Device for Point-Of-Sale Display Rack and Primarily Store Shelving. Each of these prior art displays, however, are specifically designed for a type of merchandise which is different from computer video game paks.

SUMMARY OF THE INVENTION

The invention disclosed herein is a relatively secure cabinet which provides two-sided display of modular game paks for computer video games. The display cabinet includes essentially a set of pivotable vertical enclosures or paddles, with each vertical enclosure holding several game paks for viewing at a single time. A number of vertical enclosures arranged side by side enable the purchaser to browse through a large selection of game paks. The vertical enclosures or paddles comprise transparent front and back panels for viewing the front and back sides of a game pak box, respectively, and a lockable access door for containing the game pak securely within the enclosure.

In one arrangement, the vertical enclosures, or paddles, may be flipped back and forth for viewing the front and back sides of each game pack. In another arrangement, the paddles may be spun completely around, again for viewing the front and back sides of the game pak. The cabinet system is flexible in its construction in order to meet the space limitations and other requirements of retail outlets. The display cabinet may be built in a modular construction format to fit standard size shelf areas in a retail store. For example, the paddles may be mounted on a self-standing frame, or mounted on a wall mounted set of shelf brackets, or mounted in a rotary carousel display. The display cabinet may be constructed for just displaying merchandise which is "on the shelf" with additional merchandise stocked behind the counter, or alternatively, the cabinet may include a storage locker for stocking extra merchandise at the display location.

The enclosures or paddles are able to hold various sizes of game paks, and the paddles are color coded to indicate a particular series of games produced by the manufacturer. The cabinet further provides several areas for displaying the manufacturer's trademarks and other advertising information used in connection with the sale of the merchandise.

The primary objectives of the invention are therefore to provide a display cabinet which includes a means for displaying two sides of a computer video game pak; to provide a secure cabinet for displaying game paks in a manner which is very visible to the purchaser yet prevents or at least inhibits theft of the merchandise; to provide a display cabinet which includes a vertical enclosure or other means for displaying several game paks for viewing at a single time; to provide a display cabinet which includes a set of vertical enclosures or other means for displaying a large selection of game paks in a single location; to provide a display cabinet which is adaptable to hold several different sizes of game paks; to provide a display cabinet for holding a large number of game paks of various sizes and versions, with color coded sections for indicating the particular size and version of each game pak in the display; to provide a display cabinet with additional storage space for stocking extra merchandise; and to provide a display cabinet for computer video game paks which is physically and visually interactive with the purchaser yet provides relatively good security for the merchandise within the display.

Other objects and advantages of the invention will become apparent from the following description which sets forth, by way of illustration and example, certain preferred embodiments of the invention.

BRIEF DESCRIPTION OF THE DRAWINGS

The drawings, which constitute a part of the specification and include exemplary embodiments of the present invention, include the following.

DETAILED DESCRIPTION OF THE INVENTION

Figure 1:
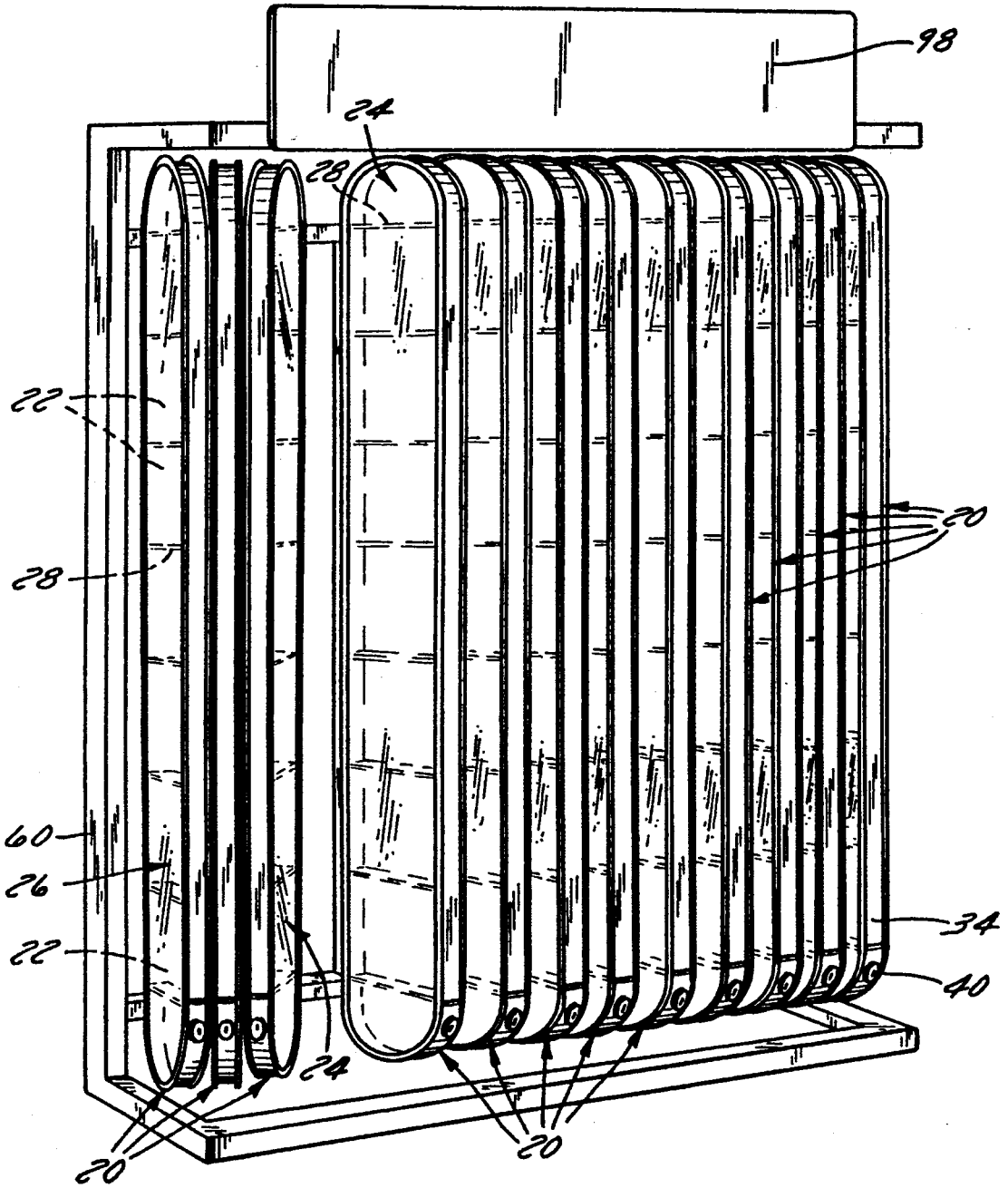
FIG. 1 is a perspective view of a first embodiment of a display cabinet constructed in accordance with the principles of the invention. Paddles which hold the game paks are pivotably hinged from the rear to a self-standing frame. The paddles may be flipped about 45° back and forth for displaying the front and back sides of the game paks contained within the paddles.

A game pak for a computer video game is typically packaged in a box 10 with a relatively large square or rectangular front side 12 and corresponding back side 14, and relatively thin edges 16. The large front side 12 of the game pak box 10 is usually printed with the title of the game, the name of the manufacturer, and a graphic depiction of the game comparable to the display on a video screen when the game is being played. The large rear side 14 of the box is usually printed with a written description of the game and other information. At least one of the edges 16 is usually printed with the name of the game and the name of the manufacturer. The display cabinet described below is designed particularly for displaying computer video game paks, although it certainly may be used for other kinds of merchandise like compact discs for music (CD's), software discs for personal computers or other similarly packaged goods.

The basic components of the display cabinet include an enclosure or paddle 20 with several compartments 22 arranged vertically on top of each other for holding several game paks 10. The paddle 20 is pivotably mounted on a frame 60, 70 or 90 for rotation to expose two transparent faces or panels 24 and 26 of the paddle 20, thereby enabling the purchaser to view the front and rear sides 12 and 14 of each game pak 10 within the paddle 20.

A paddle 20 comprises an elongated body constructed with a front facing 24 and a rear facing 26, and several evenly spaced shelves 28 forming a number of like-sized compartments 22. Each compartment 22 has a width corresponding approximately to the width of a game pak, a thickness corresponding approximately to the thickness of a game pak, and a vertical height corresponding approximately to the vertical height of a game pak. (Although the figures depict paddles thick enough to hold only one game pak in each compartment, double thickness paddles for holding two game paks in each compartment may also work.) The overall vertical height of the paddle 20 corresponds approximately to the combined vertical height of several game paks stacked one on top of another. The front face 24 and the rear face 26 of the paddle 20 are both made from a clear, hard plastic material, to enable the purchaser to see into the paddle to view the game pak 10.

One side edge 30 of the paddle enclosure 20 has a stiff metal spine 32 which wraps around a portion of each of the front facing 24 and back facing 26 of the paddle 20. The metal spine 32 provides a strong, durable support to the paddle 20. On the opposite side edge 31 of the paddle enclosure 20 is a slidable, lockable access door 34.

Figure 6A:
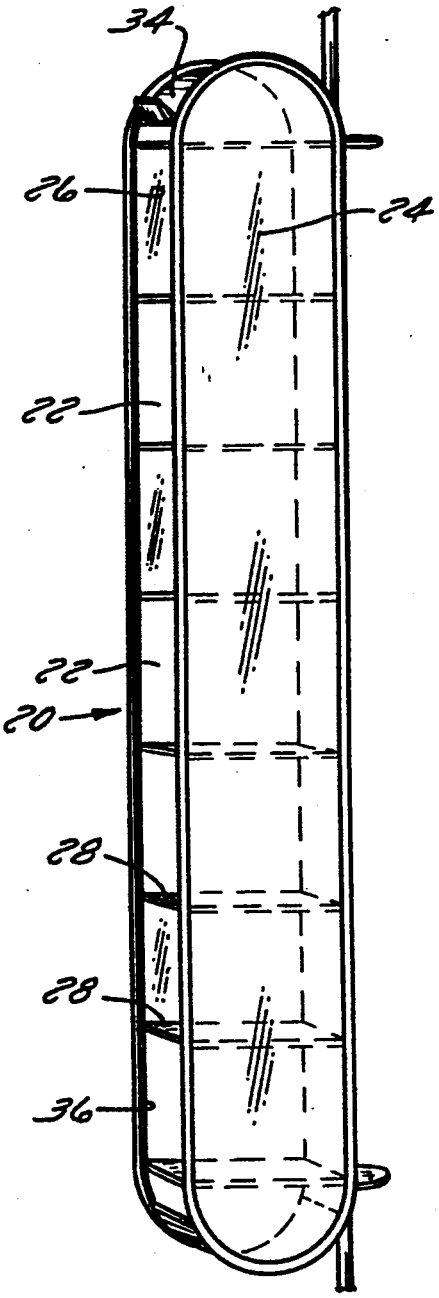
FIGS. 6A and 6B are perspective views of a paddle showing a slidable front access door in open and closed positions, respectively.
Figure 6B:
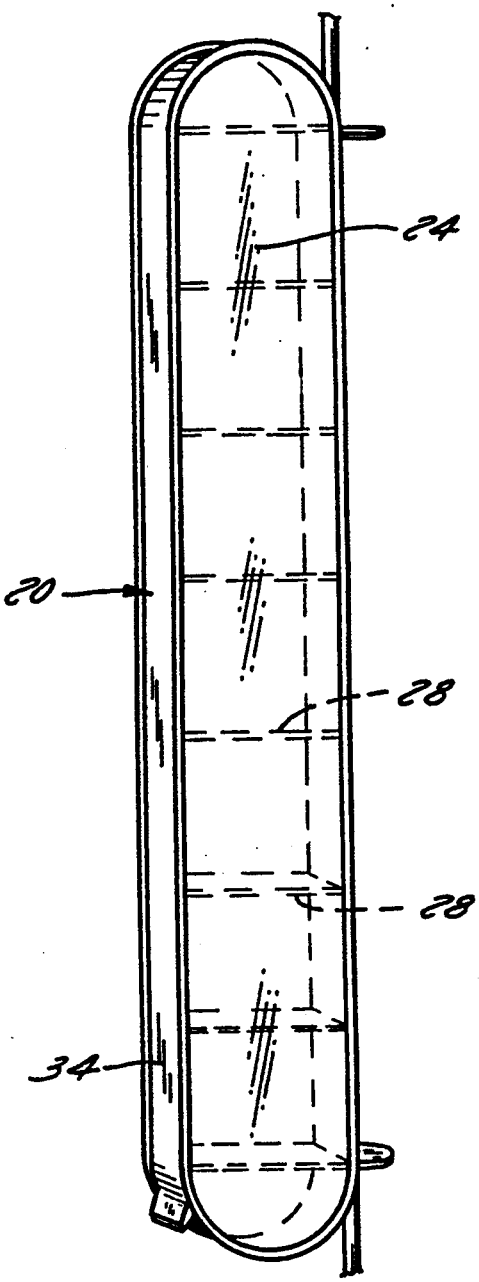

The access door 34 is made from a long strip of metal tape having a uniform width throughout its length, and a length extending from the top to the bottom of the paddle 20. The access door 34 is slidably inserted between a groove 36 formed in an edge in each of the front facing 24 and rear facing 26 of the paddle 20. The metal tape 34 is embossed with a plastic coating to prevent sharp edges on the metal tape from scratching into the plastic material of the front and rear facings 24 and 26 of the paddle 20. The access door 34 is slidable between open and closed positions, as shown in FIGS. 6A and 6B, and the access door 34 is lockable in the closed position. The grooves 36 are formed around the entire perimeter of the front and rear facings 24 and 26 of the paddle 20 so that when the access door 34 is closed, the access door 34 lies within the grooves 36 along the forward edge 31 of the paddle 20. When the access door 34 is opened, the metal tape then slides within the grooves 36 around the top portion of the paddle 20 to the back edge 30 of the paddle 20 (behind the metal spine 32).

A lower metal bracket 38 wraps around the bottom portion of the paddle to hold the front and back facings 24 and 26 securely together. The lower metal bracket 38 also contains a lock 40 for locking the access door 34 in the closed position. The lock 40 comprises a key operated rotatable locking bar 44 engageable with a slot 46 in the end of the metal tape 34. The lock 40 may be opened by a key held by the clerk at the retail store. An upper metal bracket 48 wraps around the upper portion of the paddle 20 again to hold the front and back facings 24 and 26 securely together. The upper metal bracket 48 also contains an interlocking edge 50 which engages a complimentary interlocking edge 52 on the top end of the metal tape when the access door 34 is in a closed position. The interlock prevents a person from ripping the metal tape 34 out of the top portion of the paddle 20 again to prevent theft. The front and rear facings 24 and 26, shelves 28, metal spine 32, and upper and lower metal brackets 48 and 38 are all fastened together by locknuts or other secure fasteners 54 to securely connect the individual components of the paddle 20.

Each paddle 20 is pivotably mounted onto a frame for rotation to expose the front facing 24 and rear facing 26 of the paddle 20, thereby displaying the front side 12 and back side 14 of the game pak 10, respectively. The paddles 20 may be mounted in a number of different formats. In a first embodiment shown in FIG. 1, a set of several paddles 20 are mounted side by side onto a self-standing frame 60 at spaced apart intervals for displaying a large selection of game paks. FIG. 1 depicts what may be called the "flipper mode" in that each paddle 20 is attached by means of a hinge 56 on the rear edge 30 of the paddle 20 so that it is able to be flipped back and forth a sufficient distance, about 45°, to enable the purchaser to see the two sides 12 and 14 of the game pak 10. The paddles 20 are flipped by the purchaser moving the paddles 20 with his or her hand. The hinge 56 may be formed by turned flange portions 57 and 58 on the upper and lower end of the metal spine 32. The hinge 56 pivots on a smooth nylon washer 62 to provide a smooth pivot action. The hinge 56 is locked over a pivot pin 64 by a locknut or other secure fastener 66. Stops 68 on the hinge 56 prevent one paddle 20 from banging into the next one.

Figure 2:
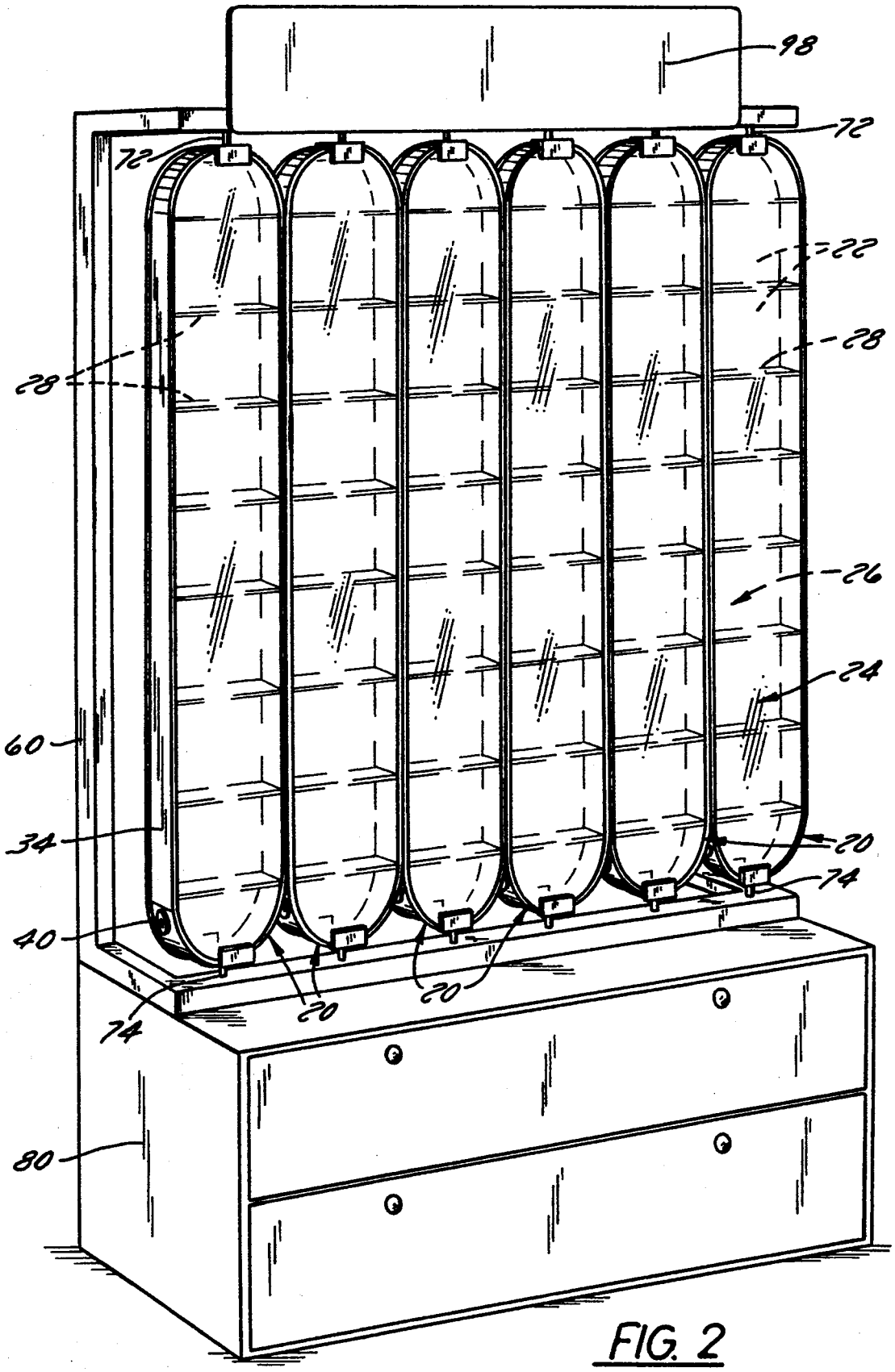
FIG. 2 is a perspective view of a second embodiment of the invention in which the paddles are attached from the top and bottom thereof by pivot pins onto a frame, thereby allowing the paddles to spin a full 360°. Extra merchandise may be stocked in a storage locker beneath the frame.

In a second embodiment, shown in FIG. 2, which maybe referred to as the "spinner mode", the vertical paddle 20 is pivotably mounted to the frame with pivot pins 72 and 74 at the top center portion and bottom center portion of the paddle. On the spinner mode, a set of several paddles 20 are mounted in spaced apart relationship such that, from the viewpoint of a purchaser standing in front of the display cabinet, the paddles 20 stand vertically adjacent next to each other so that a full view of the front facings 24 of all the paddles 20 are visible to the purchaser. In the spinner mode, the normal position of the paddle exposes the front facing 24 of the paddle 20 forward toward the purchaser standing in front of the cabinet, thereby normally displaying the graphics on the front side 12 of the game pak box 10. The paddle 20 may be spun a full 180° to expose the rear facing 26 of the paddle, so that the purchaser may read the information about the game printed on the rear side 14 of the game pack box 10. The paddle 20 may then again be rotated another 180° back to the normal, front facing position. All of the paddles 20 mounted on a spinner mode display cabinet are able to independently spin front to back in the same manner.

In the spinner mode, the paddle 20 is further set up to passively return itself to the normal front facing position after the purchaser is done viewing the merchandise. As a purchaser stands before the display cabinet, he sees the front facing 24 of the paddle 20. The purchaser may rotate the paddle 180° with his hand to expose the rear facing to read the game description on the back of the box. When the purchaser releases the paddle 20, a nylon washer 75 with a slanted surface 76 and a notch 77 carved in it at the front facing position, and a complimentary position pin 78 fastened onto and perpendicular to the lower pivot pin 74, causes the paddle 20 to automatically return to the front facing position by force of gravity. In the normal front facing position, the position pin 78 lies in the carved notch 77 in the washer 75. As the purchaser spins the paddle 20, the position pin 78 slides across the slanted upper surface 76 of the washer 75. Because the washer 75 has a slanted surface 76 with the lowest point at the notch 77, the paddle 20 upon release will automatically rotate until the position pin 78 rests in the notch 77, thereby turning the front facing 24 of the paddle 20 toward the aisle so that when the next purchaser walks up to the cabinet he or she will see the front side 12 of the game pak 10.

The framework for mounting the paddle enclosures may also be constructed in a number of formats. FIG. 1 shows a self-standing welded steel framework 60 for mounting the paddle enclosures. The framework 60 may be fabricated in any height or width desired by the retail outlet. The framework 60 may also be provided with caster wheels to enable the retail outlet to move the cabinet to any location within the store as desired.

Figure 7:
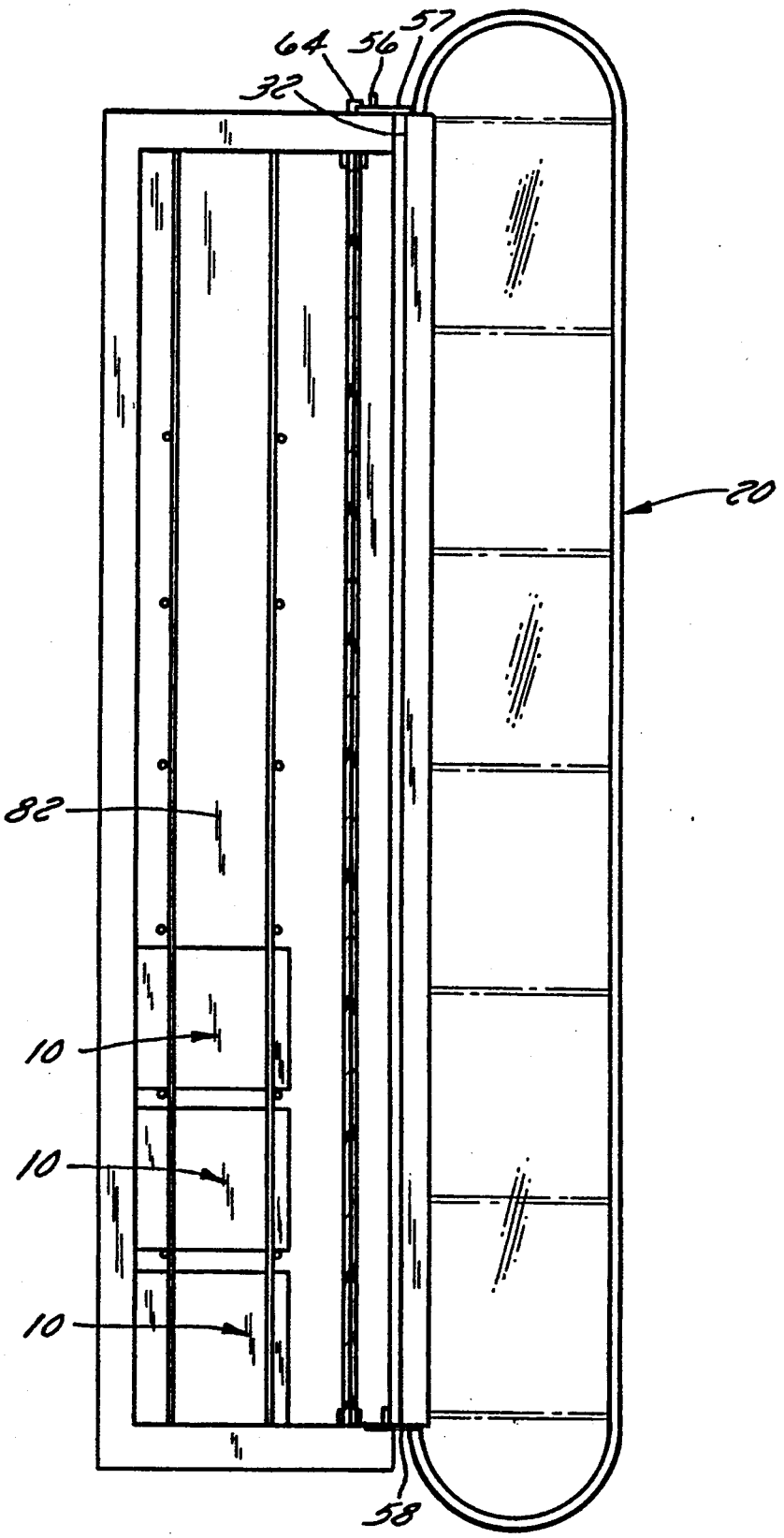
FIG. 7 is a side view of a display cabinet with a storage compartment behind the paddles for stocking extra merchandise.

FIG. 2 also shows a self standing framework 60 combined with a storage locker 80 for stocking extra merchandise. The storage locker 80 may be of any conventional form, such as a set of locked drawers, a "fishing tackle" type compartment, or any other conventional storage system for stocking extra game pak units. Instead of having the storage locker 80 beneath the frame, a set of storage shelves 82 may alternatively be placed behind the paddles 20, as shown in FIG. 7. Other display/storage combinations are possible. The additional storage space should be lockable, but handy to access.

Figure 3:
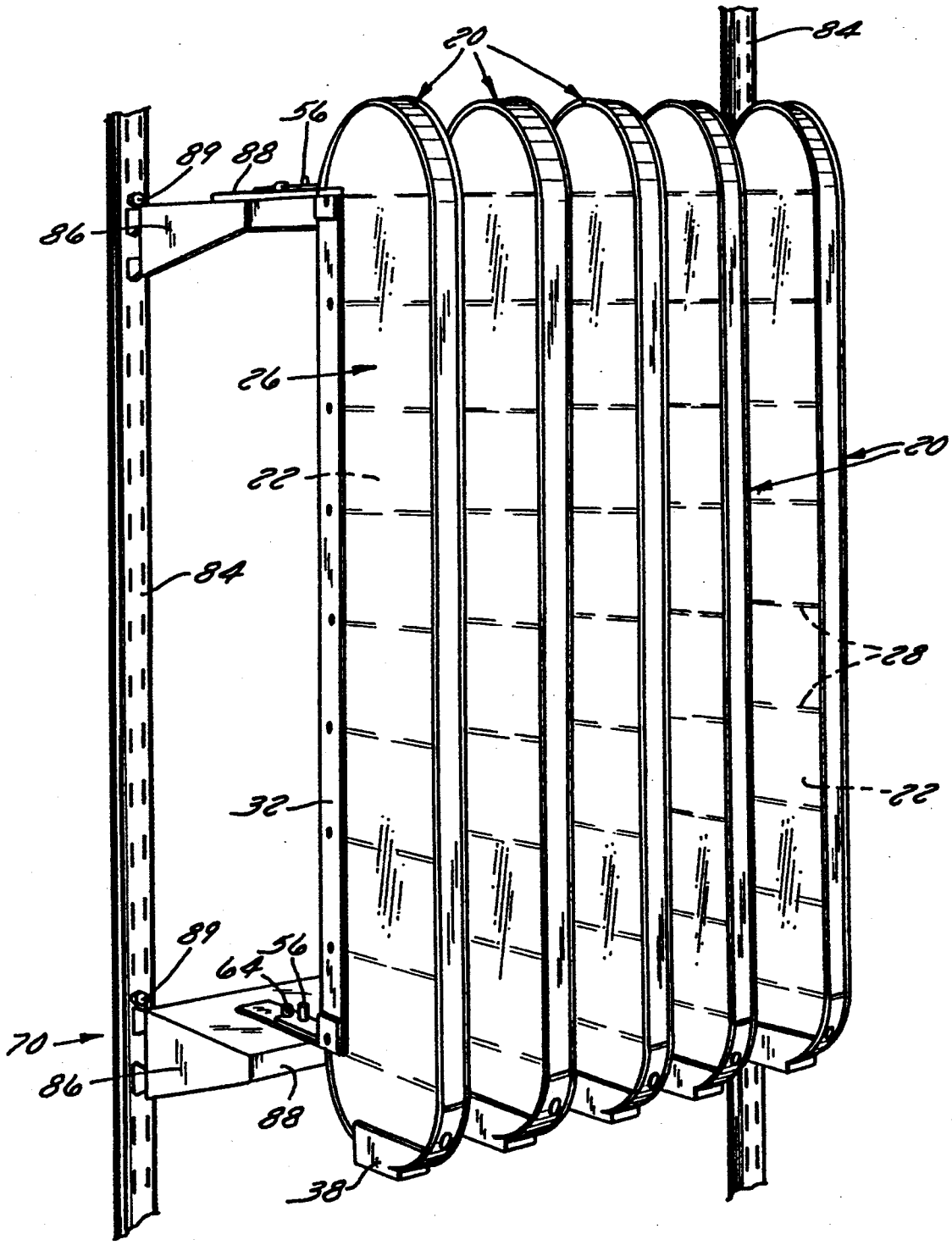
FIG. 3 is a perspective view of a third embodiment of the invention in which the paddles are pivotably hinged from the rear for flipping back and forth (similar to the first embodiment shown in FIG. 1), except that the paddles are mounted on an adjustable, modular, wall mounted bracket system.
Figure 4:
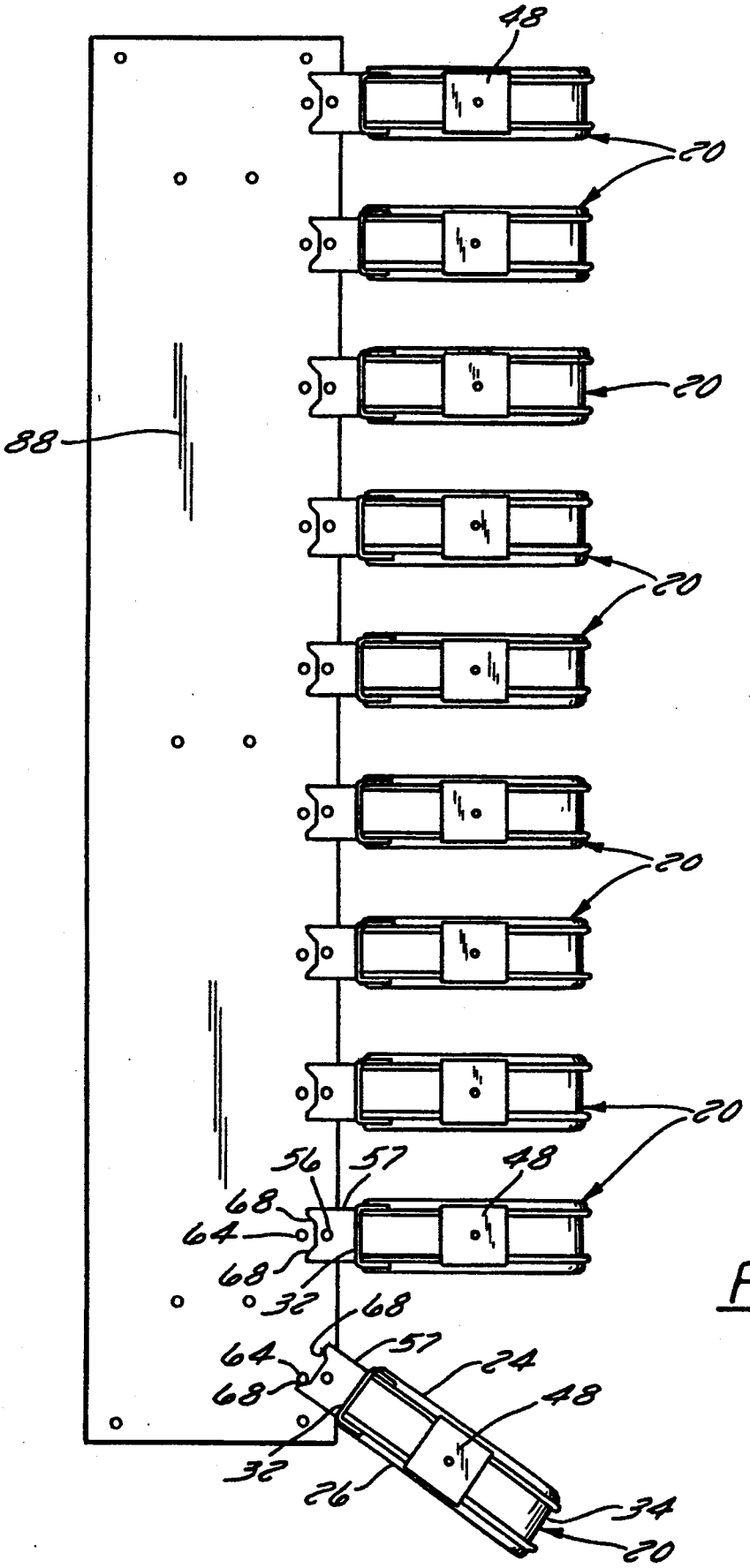
FIG. 4 is a top view of a display cabinet having rear hinge mounted paddles.
Figure 5:
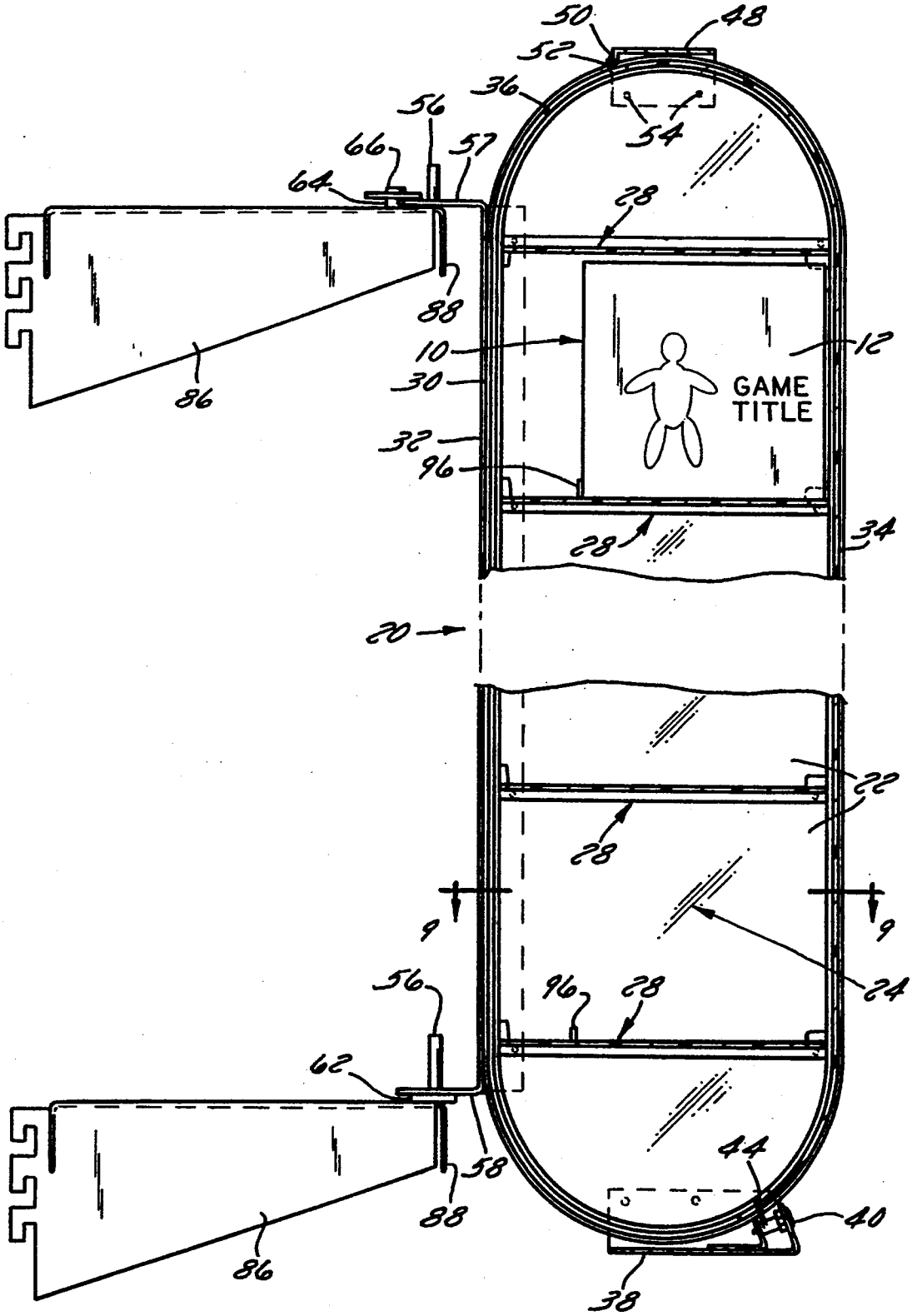
FIG. 5 is a side view partially in section of a rear hinge mounted paddle on wall mounted brackets.

FIG. 3 shows another embodiment for the framework in which the paddle enclosures are assembled on a wall mounted bracket system 70. Upright brackets 84 are fastened onto the wall surface, and shelf supports 86 are adjustably affixed to the upright wall brackets 84. Upper and lower horizontal cross bars 88 are connected across a pair of self supports 86. The paddles 20 are then pivotably mounted onto the horizontal cross bars 88. Lock bolts 89 secure the wall mounted brackets 84 and 88 together to prevent theft of an entire set of paddles 20.

The display cabinet described above may be constructed in a modular format, for example in multiples of three foot widths, in order to build a cabinet which will fit in standard sized shelf areas in a retail store.

Figure 8:
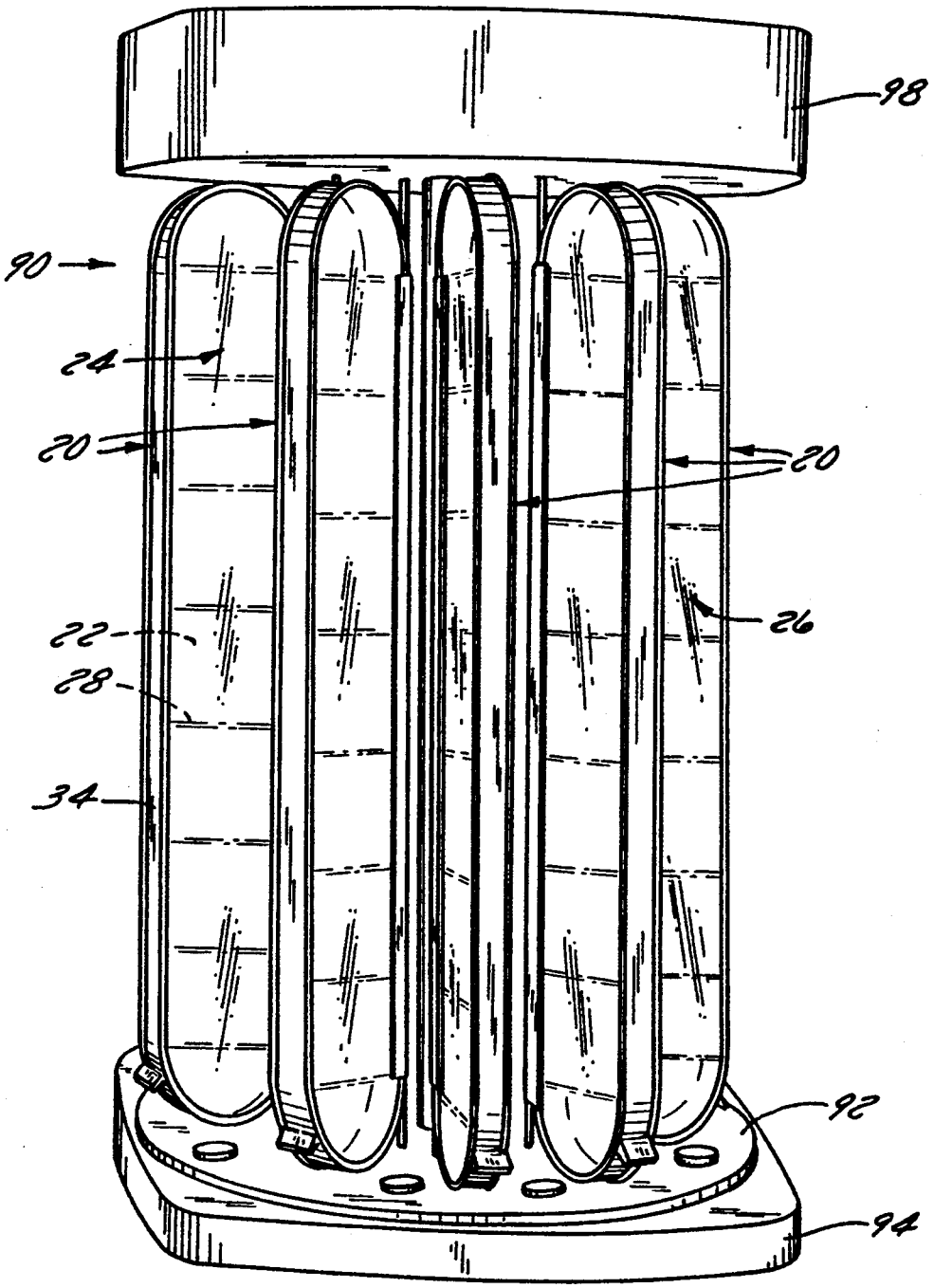
FIG. 8 is a perspective view of a carousel version of the display cabinet.
Figure 9:
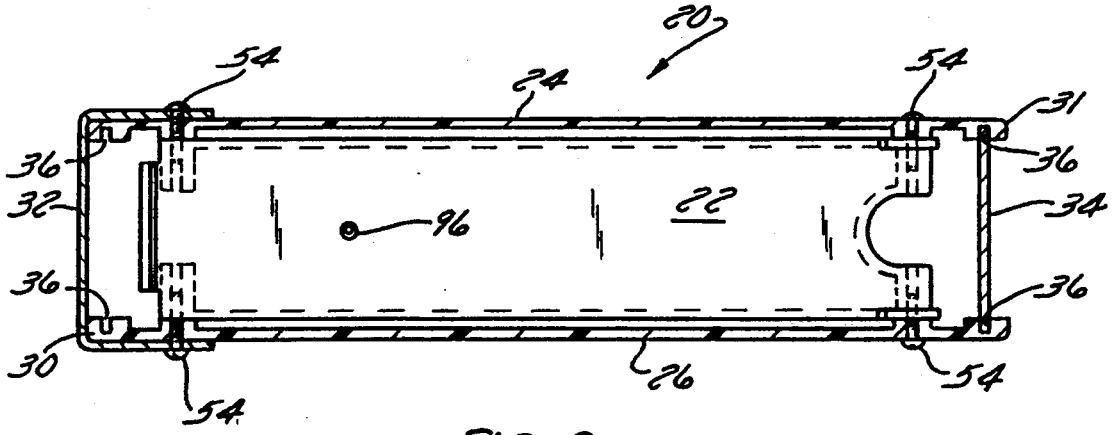
FIG. 9 is a cross-section view of a paddle at line 9—9 of FIG. 5.
Figure 10:
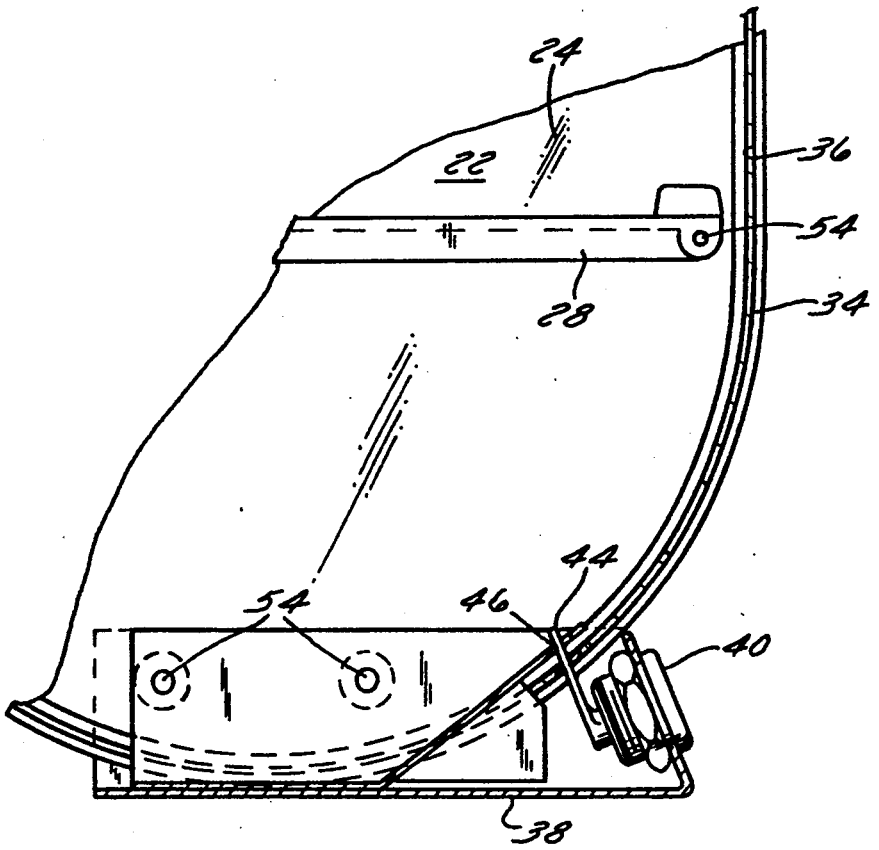
FIG. 10 is a partial cross-section view of the lower portion of a paddle showing the access door in the closed and locked position.
Figure 11:
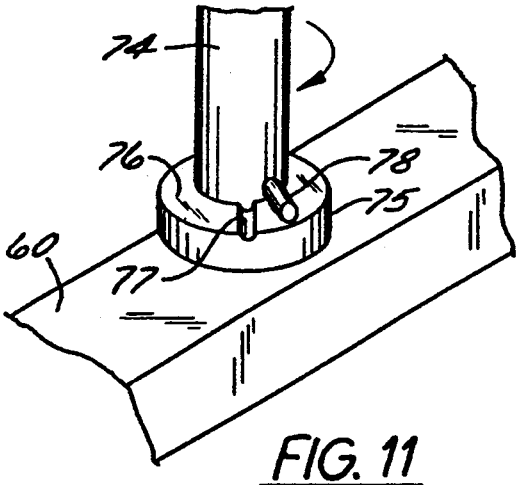
FIG. 11 is a partial view of the lower pivot pin on a spinner mode version of the cabinet (see FIG. 2) and further showing a position pin and a slanted nylon washer for automatically returning the paddle to a forward facing position.
Figure 12A:
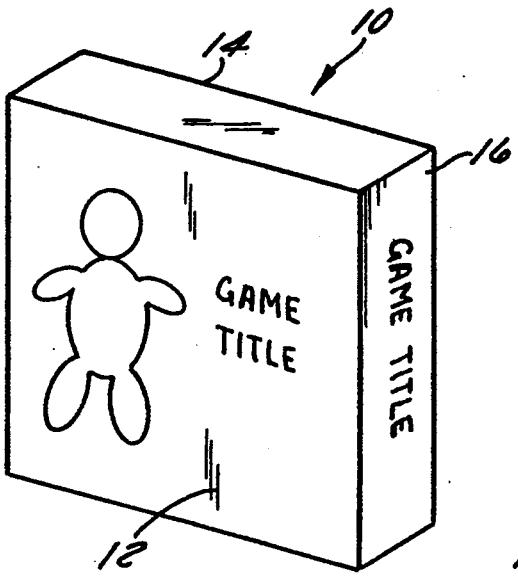
FIGS. 12A and 12B are perspective views of a typical game pak box with graphics printed on the front and a written description on the back.
Figure 12B:
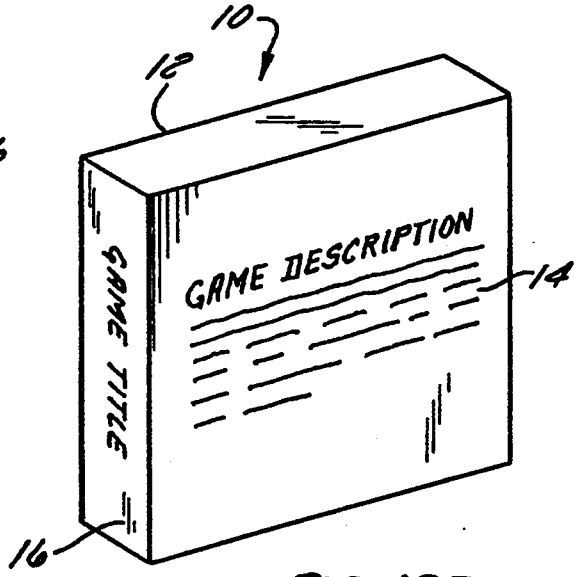

FIGS. 1, 2 and 3 show a display cabinet in the form of a panel in which all of the game paks are visible to a purchaser standing in an aisle in front of the display. Alternatively, the paddles may be mounted on a carousel unit 90 in which a set of paddles 20 may be rotated about a rotating carrier 92 on a stationary frame 94, as shown in FIG. 8.

The paddle enclosures 20, in particular the compartments 22 within the paddles, may be constructed to accommodate varying sizes of game paks 10. The shelf 28 may be molded with a pin 96 which may be later broken off in order to accommodate larger size game paks. Alternatively, the shelf 28 may be molded either with or without the pin 96 in place, in order to construct a paddle enclosure 20 which will hold the particular game paks desired by the retailer.

The figures depict a paddle enclosure 20 with a semicircular top and bottom portions. Alternatively, the paddle enclosures may be constructed with nearly square top and bottom portions, with the corners having a very small radius so that the metal tape may bend around the tight corner. The access door 34 is made of a steel banding, as opposed to a plastic material, in order to prevent "knifing through" the front access door. The spine 32 is made of metal in order to provide strength to the paddle enclosure. The remaining components, namely the front and rear facing and the shelves, may be made of a high strength polycarbonate material. Metal brackets may be periodically spaced along the outer surface of the front and back facings of the paddle and secured with lock nuts in order to provide added strength and security.

The metal spine 32 and the metal tape access door 34 may each be color coded to correspond to a particular version of games produced by the manufacturer, or alternatively printed with trademarks and logos relating to the manufacturer. A header 98 above the display may likewise be marked with the manufacturers trademark, logo or other advertising information.

Finally, it is recognized that the present invention may be constructed in a number of configurations all of which satisfy the primary objectives of providing a two-sided display of a large number of computer video game paks within a secure enclosure. Therefore, specific details of the invention disclosed above are not to be interpreted as limiting, but merely as a basis for the claims and for teaching one skilled in the art to variously practice and construct the present invention in any appropriately detailed matter. Changes may be made in details of construction of the invention without departing from the spirit of the invention, especially as defined in the following claims.

I claim:

1. A display cabinet for computer video game pales, each game pak being packaged in a box having a standardized width, height and thickness, and information being printed on front and back sides of the game pak box, the display cabinet comprising:

a set of elongated vertical paddles;

each paddle having a number of compartments for holding game pak boxes therein, with each paddle further having transparent front and back facings for viewing front and back sides of the game pak boxes, respectively, and each paddle including an access door which is slidable about an outer edge of the paddle for access into compartments; and each paddle being pivotally mounted for rotation upon a frame for exposing for viewing the from and back sides of the game pak boxes.

2. The display cabinet according to claim 1, wherein each paddle has a hinge on a rearward edge thereof for mounting the paddle onto the frame, and the paddle is flippable back and forth about the hinge a sufficient distance to expose the front and back facings for viewing.

3. The display cabinet according to claim 1, wherein each paddle is mounted onto the frame by an upper pivot pin on an upper center portion of the paddle and by a lower pivot pin on the lower center portion of the paddle, and the paddle is spinnable about the pivot pins.

4. The display cabinet according to claim 2 or 3, wherein the compartments are arranged vertically on top of each other.

5. The display cabinet according to claim 4, wherein the compartments within the paddles are formed by a set of shelves spaces apart at intervals between the front and back facings of the paddle.

6. The display cabinet according to claim 5, wherein each shelf includes a removable spacer pin.

7. The display cabinet according to claim 2 or 3, wherein the slidable door comprises a metal band inserted between a groove around an outer edge in each of the front and back facings of the paddle, and the metal band is vertically slidable between open and closed positions.

8. The display cabinet according to claim 7, wherein the metal band is coated with a plastic film or tape.

9. The display cabinet according to claim 8, wherein the plastic film or tape is printed with graphic displays identifying a manufacturer of the game pak.

10. The display cabinet according to claim 7, wherein each paddle includes a lock for locking the metal band in a closed position.

11. The display cabinet according to claim 10, wherein the lock is mounted on a lower metal flange on a lower portion of the paddle, and the lock includes a rotatable bar engageable with a slot in a lower end of the metal band, and wherein an upper metal flange on an upper portion of the paddle includes an interlocking clip engageable with a corresponding clip on an upper end of the metal band.

12. The display cabinet according to claim 2 or 3, wherein the frame comprises a self standing metal framework.

13. The display cabinet according to claim 2 or 3, wherein the frame comprises wall mounted brackets.

14. The display cabinet according to claim 2 or 3, wherein the frame comprises a carousel including a rotatable carrier on a support stand, whereby the paddles are pivotable with respect to the carrier, and the carrier is rotatable with respect to the support stand.

15. The display cabinet according to claim 2 or 3, wherein the frame further includes a storage locker for stocking extra game paks.

16. A merchandise display, wherein the merchandise to be displayed comprises a number of relatively thin box-like items with information printed on front and back sides thereof, the display comprising;

a plurality of enclosure units mounted side by side on a frame;

each enclosure unit including transparent front and back facings, and including a number of spaced apart shelves between the facings, thereby forming a number of vertically arranged compartments for holding the merchandise;

each enclosure unit having an access door slidable around an edge of the enclosure unit between open and closed positions for access into the compartments, and the access door being lockable in a closed position;

pivot means for exposing the front and back facings of the enclosure unit for viewing the front and back sides of the merchandise, respectively; and each enclosure unit being pivotable independently of the other enclosure units.

17. The display according to claim 16, wherein a back edge of the enclosure unit is hinged to the frame, and the enclosure unit if flippable back and forth a sufficient distance for viewing the front and back sides of the merchandise.

18. The display according to claim 16, wherein an upper center portion and a lower center portion of the enclosure unit are mounted on the frame by upper and lower pivot pins, respectively, and the enclosure unit is spinnable about the pivot pins for viewing the from and back sides of the merchandise.

19. The display according to claim 18, further including means for, upon release, automatically returning the enclosure unit to a front facing forward position.

20. The display according to claim 19, wherein the means for returning the enclosure unit comprises a locator pin slidable about a washer having an inclined surface and a notch for holding the locator pin at the front facing forward position.

21. The display according to claim 17 or 18 wherein the compartments are arranged vertically on top of each other.

22. The display according to claim 17 or 18, wherein each shelf includes a removable spacer pin.

23. The display according to claim 17 or 18 wherein the access door comprises a metal band inserted between a groove round an outer edge in each of the front and back facings of the enclosure unit.

24. The display according to claim 23, wherein the metal band is coated with a plastic film or tape.

25. The display according to claim 24, wherein the plastic film or tape is printed with graphic displays identifying a manufacturer of the game pak.

26. The display according to claim 23, wherein each paddle includes a lock for locking the metal band in a closed position.

27. The display according to claim 26, wherein the lock is mounted on a lower metal flange on a lower portion of the enclosure unit, and the lock is engageable with a slot in a lower end of the metal band, and wherein an upper metal flange on an upper portion of the enclosure unit includes an interlocking clip engageable with a corresponding clip on an upper end of the metal band.

28. The display according to claim 17 or 18, wherein the frame comprises a self-standing metal framework.

29. The display according to claim 17 or 18, wherein the frame comprises wall mounted brackets.

30. The display according to claim 17 and 18, wherein the frame comprises a carousel including a rotatable carrier on a support, whereby the enclosure units arc pivotable with respect to the carrier, and the carrier is rotatable with respect to the support stand.

31. The display according to claim 17 or 18, wherein the frame further includes a storage locker for stocking extra game paks.

* * * * *